US010543678B2

(12) United States Patent
Nakaya et al.

(10) Patent No.: US 10,543,678 B2
(45) Date of Patent: Jan. 28, 2020

(54) PRINTING APPARATUS THAT SPECIFIES A REGION OF A TRANSFER MEMBER HAVING A POOR SURFACE CONDITION AND PROHIBITS PRINTING IN THE REGION, AND RELATED PRINT CONTROL METHOD

(71) Applicant: CANON KABUSHIKI KAISHA, Tokyo (JP)

(72) Inventors: Yusuke Nakaya, Inagi (JP); Ryosuke Sato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/030,231

(22) Filed: Jul. 9, 2018

(65) Prior Publication Data

US 2019/0016115 A1 Jan. 17, 2019

(30) Foreign Application Priority Data

Jul. 13, 2017 (JP) ..... 2017-137339

(51) Int. Cl.
*B41J 2/00* (2006.01)
*B41J 2/005* (2006.01)

(52) U.S. Cl.
CPC ..... *B41J 2/0057* (2013.01)

(58) Field of Classification Search
CPC ..... B41J 2/0057
See application file for complete search history.

(56) References Cited

U.S. PATENT DOCUMENTS 4,987,484 A 1/1991 Ikeda et al.
9,193,149 B2 11/2015 Kelly et al.
2005/0145128 A1* 7/2005 Hesterman ..... B41J 2/0057 101/409
2009/0321520 A1 12/2009 Martenson et al.
2012/0274914 A1 11/2012 Stowe et al.
(Continued)

FOREIGN PATENT DOCUMENTS

CN 101614559 A 12/2009
CN 104220935 A 12/2014
(Continued)

OTHER PUBLICATIONS

Extended European Search Report dated Dec. 10, 2018, issued in European Patent Application No. 18179812.5.
(Continued)

*Primary Examiner* — Jason S Uhlenhake
(74) *Attorney, Agent, or Firm* — Venable LLP

(57) ABSTRACT

A printing apparatus includes a transfer member that rotates, a printhead configured to form an image on the transfer member, and a transfer unit configured to transfer, to a print medium, the image formed on the transfer member. A detection unit is configured to detect a surface condition of the transfer member, and a specifying unit is configured to specify a region of the transfer member in which the surface condition is poor, based on a detection result output by the detection unit. In addition, a prohibiting unit is configured to prohibit image formation by the printhead for the region of the transfer member, specified by the specifying unit, for which the surface condition is poor.

15 Claims, 12 Drawing Sheets

(56) References Cited

U.S. PATENT DOCUMENTS

| | | | |
|---|---|---|---|
| 2015/0042736 | A1 | 2/2015 | Landa et al. |
| 2015/0210065 | A1 | 7/2015 | Kelly et al. |

FOREIGN PATENT DOCUMENTS

| | | | |
|---|---|---|---|
| JP | 07156427 | A2 * | 6/1995 |
| JP | H07-156427 | A | 6/1995 |
| WO | 2016059995 | A1 | 4/2016 |

OTHER PUBLICATIONS

Chinese Office Action issued in corresponding Chinese Application No. 201810756740.6 dated Dec. 6, 2019.

* cited by examiner

PRINTING APPARATUS THAT SPECIFIES A REGION OF A TRANSFER MEMBER HAVING A POOR SURFACE CONDITION AND PROHIBITS PRINTING IN THE REGION, AND RELATED PRINT CONTROL METHOD

This application claims the benefit of Japanese Patent Application No. 2017-137339, filed Jul. 13, 2017, which is hereby incorporated by reference herein in its entirety.

BACKGROUND OF THE INVENTION

Field of the Invention

The present invention relates to a printing apparatus and a related print control method thereof, and, more particularly, for example, to a printing apparatus that transfers, to a print medium, an image formed by discharging ink to a transfer member from a printhead and prints the image, and a related print control method.

Description of the Related Art

Conventionally, there is known a printing apparatus that performs printing by forming an image on an intermediate transfer member with a printhead, and transferring the formed image to a print medium. In the printing apparatus thus configured, it is necessary to maintain the condition of the intermediate transfer member satisfactorily. The intermediate transfer member deteriorates, however, as the apparatus is used. Hence, there is a demand to be able to perform print control according to deterioration of an intermediate transfer member.

For example, Japanese Patent Laid-Open No. 7-156427 proposes an apparatus that reduces dirt or a change in print density caused by deterioration in an intermediate transfer member, and prints an image that is always stable and uniform by controlling power supply energy to a thermal head or a transfer condition to a printing paper sheet in accordance with a deterioration condition of the intermediate transfer member.

In the related art, however, it is impossible to locate a specific portion in which deterioration occurs in the intermediate transfer member, and thus, it is impossible to use a portion in which no deterioration occurs preferably. For example, in an apparatus configured to divide the surface of the intermediate transfer member into a plurality of transfer regions and to perform printing for each of the divided transfer regions, it is impossible to determine a condition for each transfer region.

SUMMARY OF THE INVENTION

Accordingly, the present invention is conceived as a response to the above-described disadvantages of the conventional art.

For example, a printing apparatus and a related print control method according to this invention are capable of detecting the condition of a transfer member in finer units, controlling image formation on the transfer member in accordance with a detection result, and implementing satisfactory image formation.

According to one aspect, the present invention provides a printing apparatus comprising a transfer member that rotates, a printhead configured to form an image on the transfer member, a transfer unit configured to transfer, to a print medium, the image formed on the transfer member, a detection unit configured to detect a surface condition of the transfer member, and a restriction unit configured to restrict image formation by the printhead for a region, determined by the detection unit, for which a surface condition is poor.

According to another aspect, the present invention provides a print control method of a printing apparatus that includes a transfer member that rotates, a printhead configured to form an image on the transfer member, and a transfer unit configured to transfer, to a print medium, the image formed on the transfer member, the method comprising detecting a surface condition of the transfer member, and restricting image formation by the printhead for a region for which it is determined that the detected surface condition is poor.

The invention is particularly advantageous since it is possible to implement satisfactory image formation by restricting image formation for a portion in which the condition of the transfer member is poor and forming an image in a portion in which the condition of the transfer member is good.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings. Note that in each drawing, arrows X and Y indicate horizontal directions perpendicular to each other, and an arrow Z indicates an up/down direction.

Description of Terms

In this specification, the terms "print" and "printing" not only include the formation of significant information, such as characters and graphics, but also broadly include the formation of images, figures, patterns, and the like, on a print medium, or the processing of the medium, regardless of whether they are significant or insignificant and regardless of whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereafter) should be broadly interpreted to be similar to the definition of "print" described above. That is, "ink" includes a liquid that, when applied onto a print medium, can form images, figures, patterns, and the like, can process the print medium, and can process ink. The process of ink includes, for example, solidifying or insolubilizing a coloring agent contained in ink applied to the print medium. Note that this invention is not limited to any specific ink component. It is assumed, however, that this embodiment uses water-base ink including water, resin, and pigment serving as coloring material.

Further, a "print element (or nozzle)" generally means an ink orifice or a liquid channel communicating with the ink orifice, and an element for generating energy used to discharge ink, unless otherwise specified.

Printing System

Figure 1:
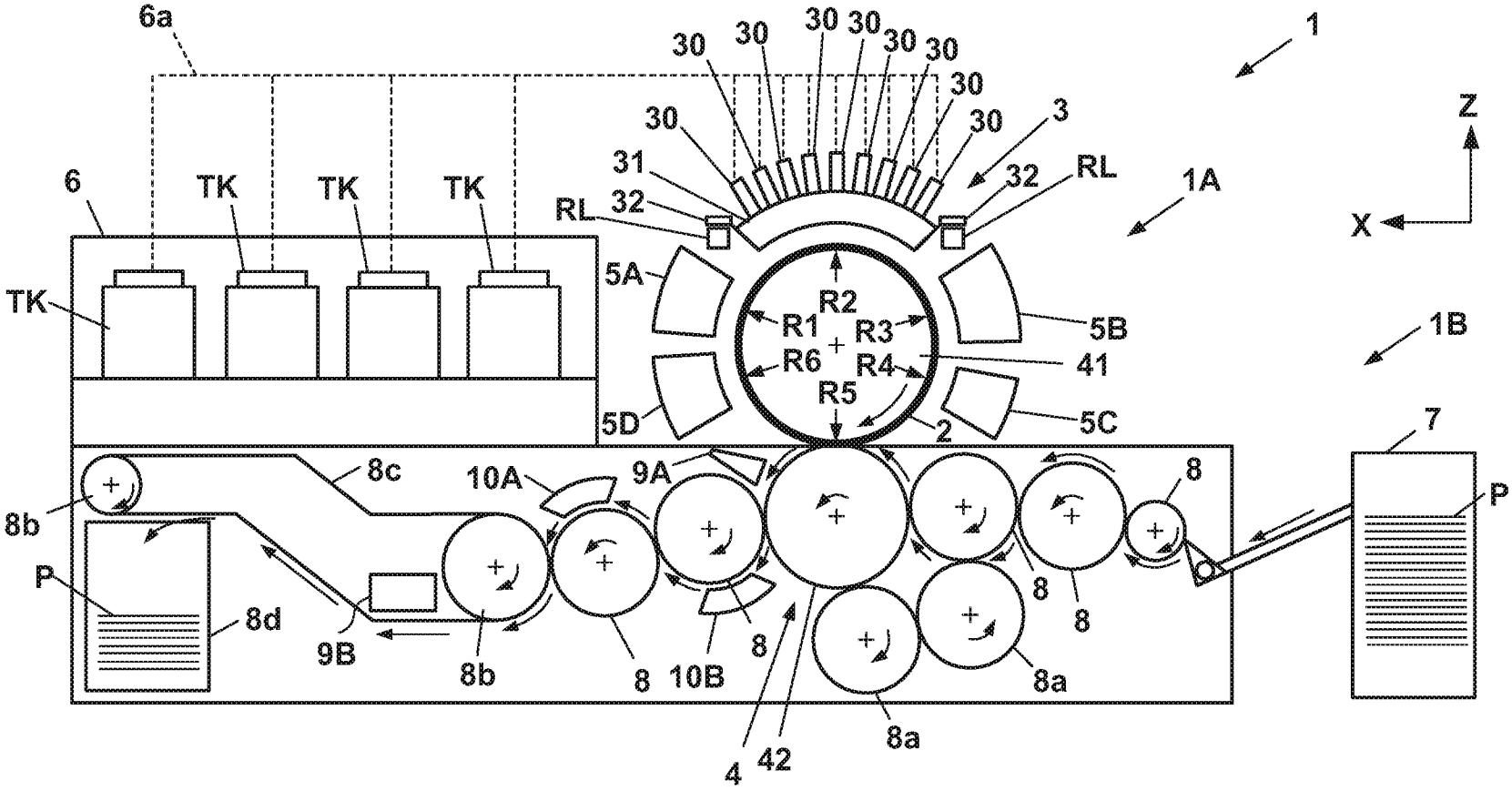
FIG. 1 is a schematic view showing a printing system according to an embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Printing Apparatus

The printing apparatus 1A includes a print unit 3, a transfer unit 4, peripheral units 5A to 5D, and a supply unit 6.

Print Unit

Figure 2:
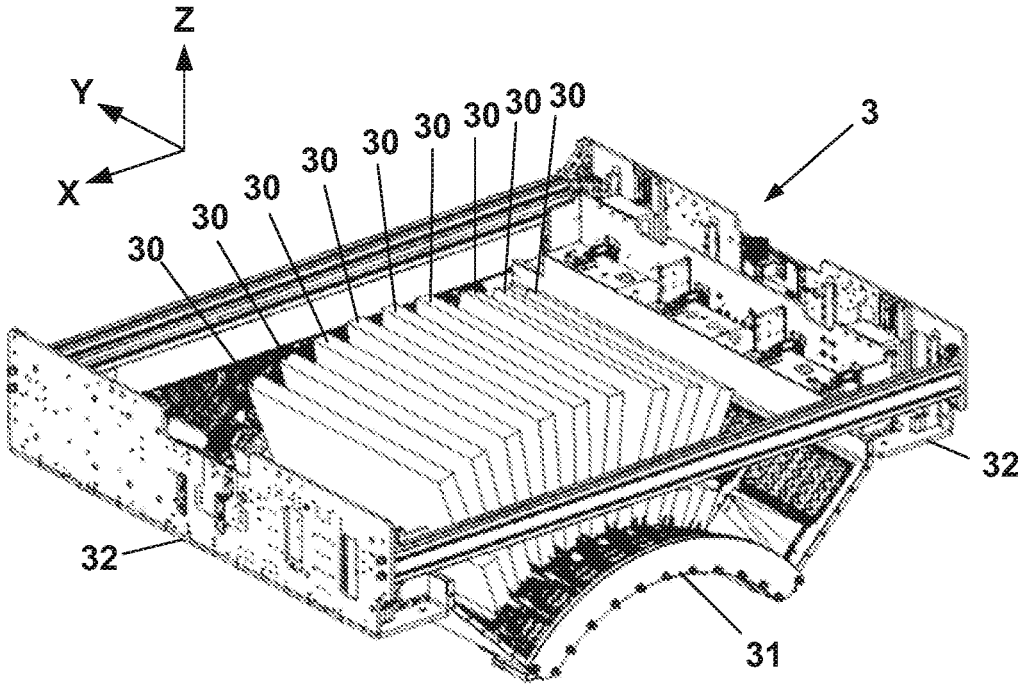
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range in which they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move in a circular orbit cyclically, and thus, the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like, can be used as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material, and include yellow ink, magenta ink, cyan ink, black ink, and the like. One printhead 30 discharges one kind of ink. One printhead 30 may be configured, however, to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
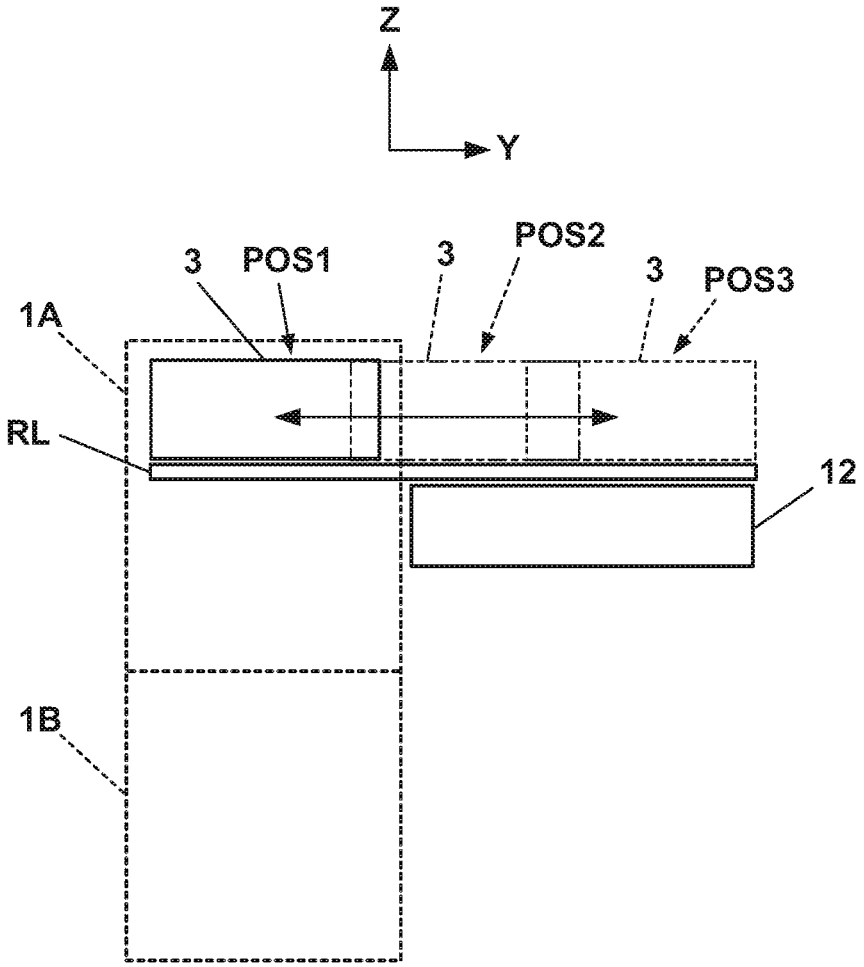
FIG. 3 is an explanatory view showing a displacement mode of the print unit shown in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism that caps the ink discharge surface of each printhead 30, a wiper mechanism that wipes the ink discharge surface, and a suction mechanism that sucks ink in the printhead 30 by a negative pressure from the ink discharge surface, can be used as the mechanism.

The guide member RL is elongated over the recovery unit 12 from the side of the transfer member 2. By the guide of the guide member RL, the print unit 3 is displaceable between a discharge position POS1, at which the print unit 3 is indicated by a solid line, and a recovery position POS3, at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2, while the printheads 30 move from the discharge position POS1 to the recovery position POS3.

Transfer Unit

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates counterclockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths divided into a plurality of segments. The respective segments can be arranged in an arc at an equal pitch on the outer peripheral surface of the transfer drum 41.

The transfer member 2 moves cyclically in the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area in which preprocessing is performed on the transfer member 2 before the print unit 3 discharges ink and an area in which the peripheral unit 5A performs processing. In this embodiment, a reactive liquid is applied. The discharge area R2 is a formation area in which the print unit 3 forms an ink image by discharging ink to the transfer member 2. The processing areas R3 and R4 after discharge are processing areas in which processing is performed on the ink image after ink discharge. The processing area R3 after discharge is an area in which the peripheral unit 5B performs processing, and the processing area R4 after discharge is an area in which the peripheral unit 5C performs processing. The transfer area R5 is an area in which the transfer unit 4 transfers the ink image on the transfer member 2 to the print medium P. The processing area R6 after transfer is an area in which post processing is performed on the transfer member 2 after transfer and an area in which the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer, but, alternatively, may be an accumulative body of a plurality of layers. If the transfer member 2 is formed by the plurality of layers, it may include three layers of, for example, a surface layer, an elastic layer, and a compressed layer. The surface layer is an outermost layer having an image formation surface on which the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials, such as a resin and a ceramic, can be used appropriately. With respect to durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of these treatments may be combined. It is also possible to provide any desired surface shape in the surface layer.

For example, acrylonitrile-butadiene rubber, acrylic rubber, chloroprene rubber, urethane rubber, silicone rubber, or the like, can be used as a material for the compressed layer. When such a rubber material is formed, a porous rubber material may be formed by blending a predetermined amount of a vulcanizing agent, vulcanizing accelerator, or the like, and further blending a foaming agent, or a filling agent, such as hollow fine particles or salt, as needed. Consequently, a bubble portion is compressed along with a volume change with respect to various pressure fluctuations, and thus, deformation in directions other than a compression direction is small, making it possible to obtain more stable transferability and durability. As the porous rubber material, there are a material having an open cell structure, in which respective pores continue to each other, and a material having a closed cell structure, in which the respective pores are independent of each other. Either structure may, however, be used, or both of these structures may be used.

As a member for the elastic layer, the various materials, such as the resin and the ceramic, can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer, and between the elastic layer and the compressed layer, various adhesives or double-sided adhesive tapes can also be used in order to fix the respective layers to each other. The transfer member 2 may also include a reinforce layer high in compressive modulus in order to suppress elongation in a horizontal direction or to maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism that grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source, such as a motor, that drives them. A driving force can be delivered by a transmission mechanism, such as a gear mechanism.

Peripheral Unit

The peripheral units 5A to 5D are arranged around the transfer drum 41. In this embodiment, the peripheral units 5A to 5D are specifically an application unit, an absorption unit, a heating unit, and a cleaning unit, in order.

The application unit 5A is a mechanism that applies the reactive liquid onto the transfer member 2 before the print unit 3 discharges ink. The reactive liquid is a liquid that contains a component increasing an ink viscosity. An increase in ink viscosity here means that a coloring material, a resin, and the like, that form the ink react chemically or suck physically by contacting the component that increases the ink viscosity, recognizing the increase in ink viscosity. This increase in ink viscosity includes not only a case in which an increase in viscosity of entire ink is recognized, but also a case in which a local increase in viscosity is generated by coagulating some of components, such as the coloring material and the resin, that form the ink.

The component that increases the ink viscosity can use, without particular limitation, a substance, such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like, can be used as a mechanism that applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism that absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or less than 10 μm in order to suppress adherence of an ink solid content to the liquid absorbing member. The pore size here refers to an average diameter, and can be measured by a known means, such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like, contained in the ink or reactive liquid can be used as the liquid component.

The heating unit 5C is a mechanism that heats the ink image on the transfer member 2 before transfer. A resin in the ink image melts by heating the ink image, improving transferability to the print medium P. A heating temperature can be equal to or greater than the minimum film forming temperature (MFT) of the resin. The MFT can be measured by each apparatus that complies with a generally known method, such as JIS K 6828-2: 2003 or ISO 2115: 1996. From the viewpoint of transferability and image robustness, the ink image may be heated at a temperature greater than the MFT by 10° C. or higher, or may further be heated at a temperature greater than the MFT by 20° C. or higher. The heating unit 5C can use a known heating device, for example, various lamps, such as infrared rays, a warm air fan, or the like. An infrared heater can be used in terms of heating efficiency.

The cleaning unit 5D is a mechanism that cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like, as needed. A known shape, such as a roller shape or a web shape, can be used for a cleaning member used for cleaning.

As described above, in this embodiment, the application unit 5A, the absorption unit 5B, the heating unit 5C, and the cleaning unit 5D are included as the peripheral units. Cooling functions of the transfer member 2 may, however, be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2, such that the temperature of the discharged ink is maintained below the boiling point of water.

The cooling unit may be an air blowing mechanism that blows air to the transfer member 2, or a mechanism that brings a member (for example, a roller) into contact with the transfer member 2 and cools this member by air-cooling or water-cooling. The cooling unit may be a mechanism that cools the cleaning member of the cleaning unit 5D. A cooling timing may be a period before application of the reactive liquid after transfer.

Supply Unit

The supply unit 6 is a mechanism that supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism that deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

Conveyance Apparatus

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit in which the plurality of print media P are stacked, and a feeding mechanism that feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism that grips the leading edge portion of the print medium P (printed product P') is provided on the outer peripheral surface of each of the conveyance drums 8 and 8*a*. A gripping operation and a release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side, and, instead, is transferred to the conveyance drums 8*a* from the pressurizing drum 42 after transfer onto the surface. The print medium P is reversed via the two conveyance drums 8*a* and is transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

Post Processing Unit

The conveyance apparatus 1B includes post processing units 10A and 10B. The post processing units 10A and 10B are mechanisms that are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, improving a glossiness, and the like, of an image on the image printed surface of the printed product P'. For example, liquid application, sheet welding, lamination, and the like, can be used as an example of coating.

Inspection Unit

The conveyance apparatus 1B includes inspection units 9A and 9B. The inspection units 9A and 9B are mechanisms that are arranged on the downstream side of the transfer unit 4, and inspect the printed product P'.

In this embodiment, the inspection unit 9A is an image capturing apparatus that captures an image printed on the printed product P' and includes an image sensor, for example, a charge coupled device (CCD) sensor, a complementary metal oxide semiconductor (CMOS) sensor, or the like. The inspection unit 9A captures a printed image while a printing operation is performed continuously. Based on the image captured by the inspection unit 9A, it is possible to confirm a temporal change in tint, or the like, of the printed image and to determine whether to correct image data or to print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

Control Unit

Figure 4:
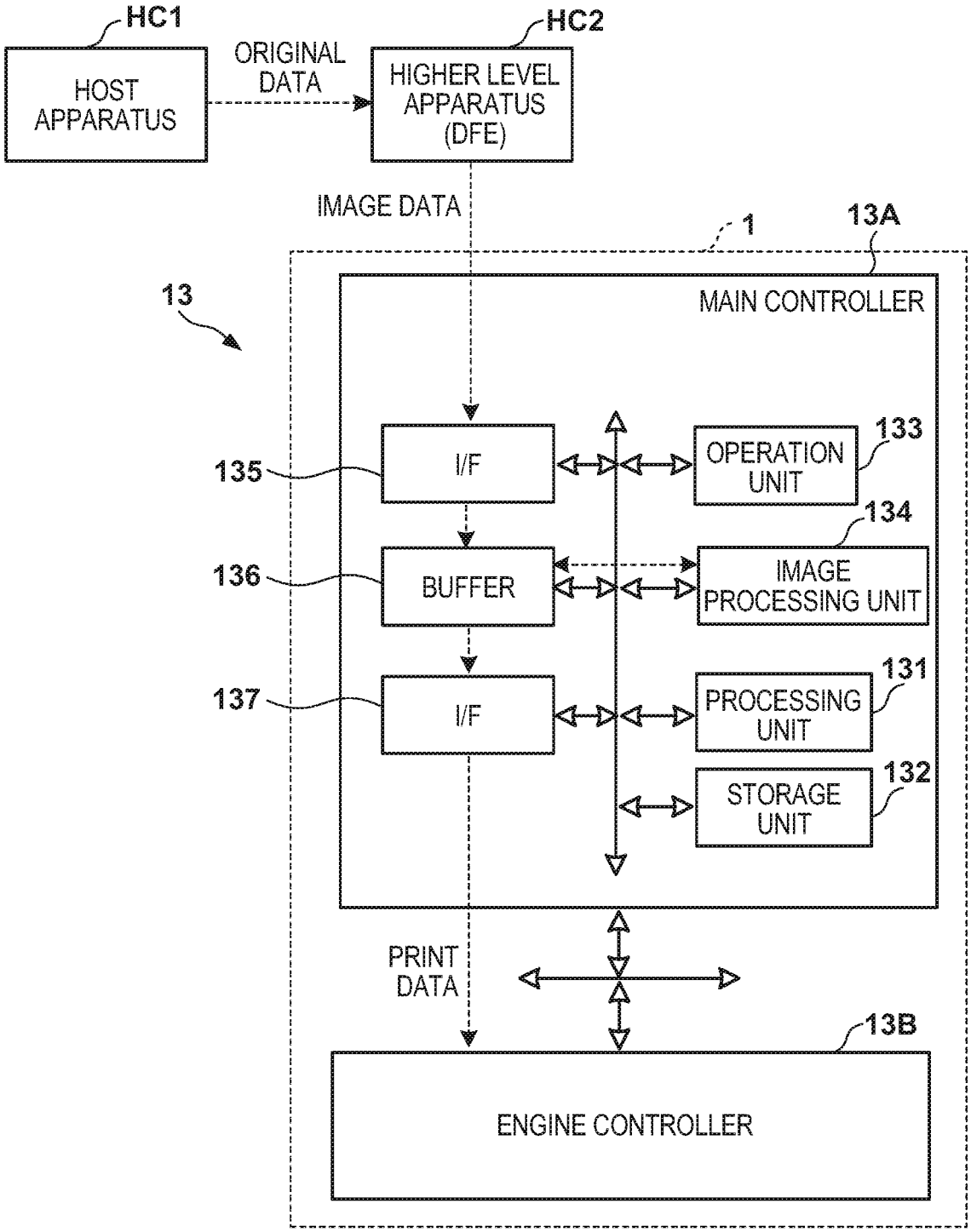
FIG. 4 is a block diagram showing a control system of the printing system shown in FIG. 1.
Figure 5:
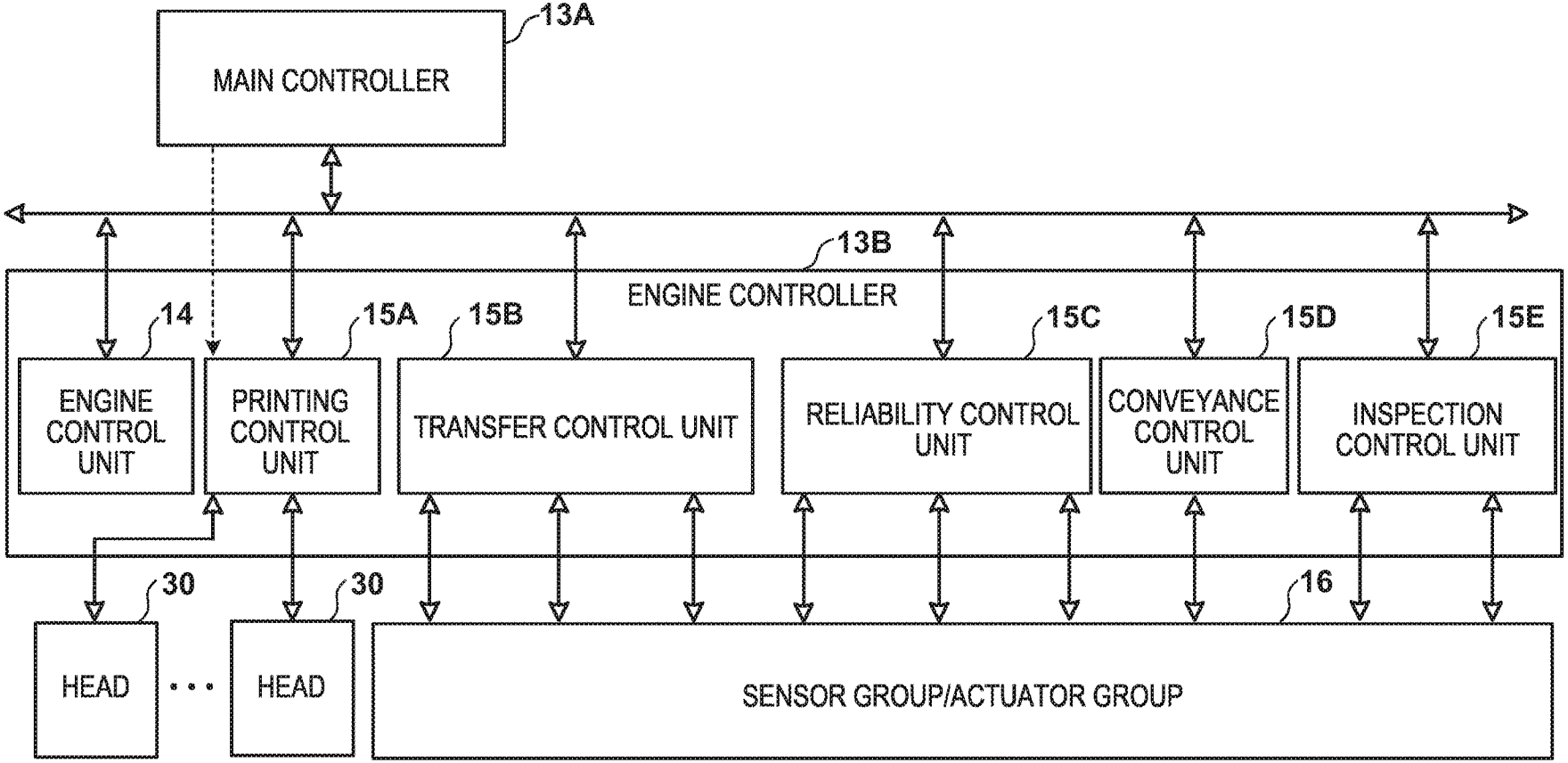
FIG. 5 is a block diagram showing the control system of the printing system shown in FIG. 1.

A control unit of the printing system 1 will be described next. FIGS. 4 and 5 are block diagrams each showing a control unit 13 of the printing system 1. The control unit 13 is communicably connected to a higher level apparatus (DFES) HK, and the higher level apparatus HK is communicably connected to a host apparatus HCl.

The host apparatus HCl may be, for example, a personal computer (PC) serving as an information processing apparatus, or a server apparatus. A communication method between the host apparatus HCl and the higher level apparatus HK may be, without particular limitation, either wired or wireless communication.

Original data to be the source of a printed image is generated or saved in the host apparatus HCl. The original data here is generated in the format of, for example, an electronic file, such as a document file or an image file. This original data is transmitted to the higher level apparatus HK. In the higher level apparatus HK, the received original data is converted into a data format (for example, red, green, blue (RGB) data that represents an image by RGB) available by the control unit 13. The converted data is transmitted from the higher level apparatus HK to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication interface (I/F) 135, a buffer 136, and a communication I/F 137.

The processing unit 131 is a processor, such as a central processing unit (CPU), executes programs stored in the storage unit 132, and controls the entire main controller 13A. The storage unit 132 is a storage device, such as a random access memory (RAM), a read only memory (ROM), a hard disk, or a solid state drive (SSD), stores data and the programs executed by the processing unit (CPU) 131, and provides the processing unit (CPU) 131 with a work area. An external storage unit may further be provided in addition to the storage unit 132. The operation unit 133 is, for example, an input device, such as a touch panel, a keyboard, or a mouse, and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HCl or the higher level apparatus HK.

The image processing unit 134 is, for example, an electronic circuit including an image processing processor. The buffer 136 is, for example, a RAM, a hard disk, or an SSD. The communication I/F 135 communicates with the higher level apparatus HK, and the communication I/F 137 communicates with the engine controller 13B. In FIG. 4, broken-line arrows exemplify the processing sequence of image data. Image data received from the higher level apparatus HK via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes an engine control units 14 and 15A to 15E, and obtains a detection result of a sensor group/actuator group 16 of the printing system 1 and controls driving of the groups. Each of these control units includes a processor, such as a CPU, a storage device, such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data, or the like, in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism that moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
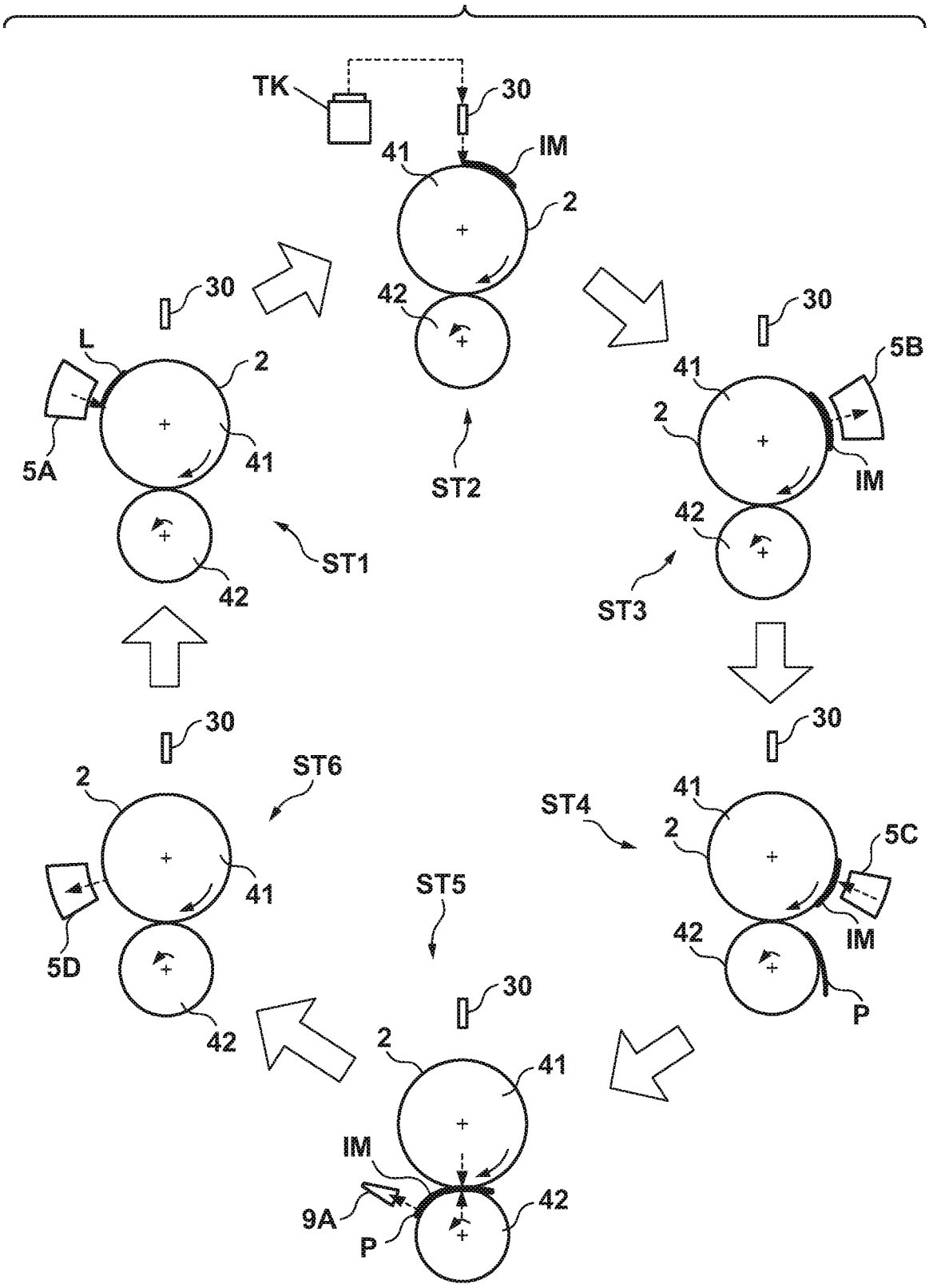
FIG. 6 is an explanatory view showing an example of the operation of the printing system shown in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion in which the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
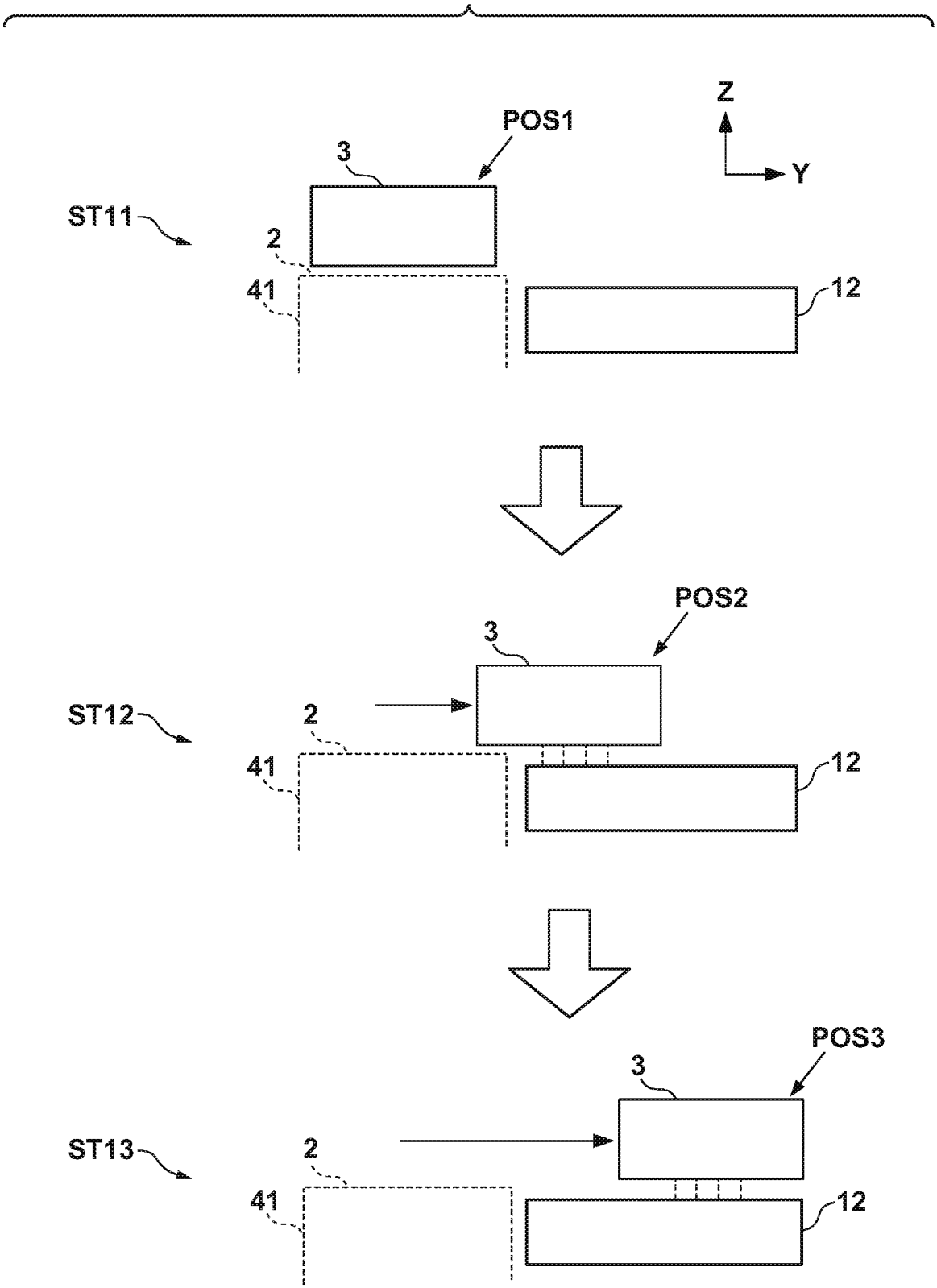
FIG. 7 is an explanatory view showing an example of the operation of the printing system shown in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

An arrangement that inspects a surface condition of the transfer member in the printing system having the above arrangement will be described next.

Detailed Description of Surface Inspection of Transfer Member

Figure 8:
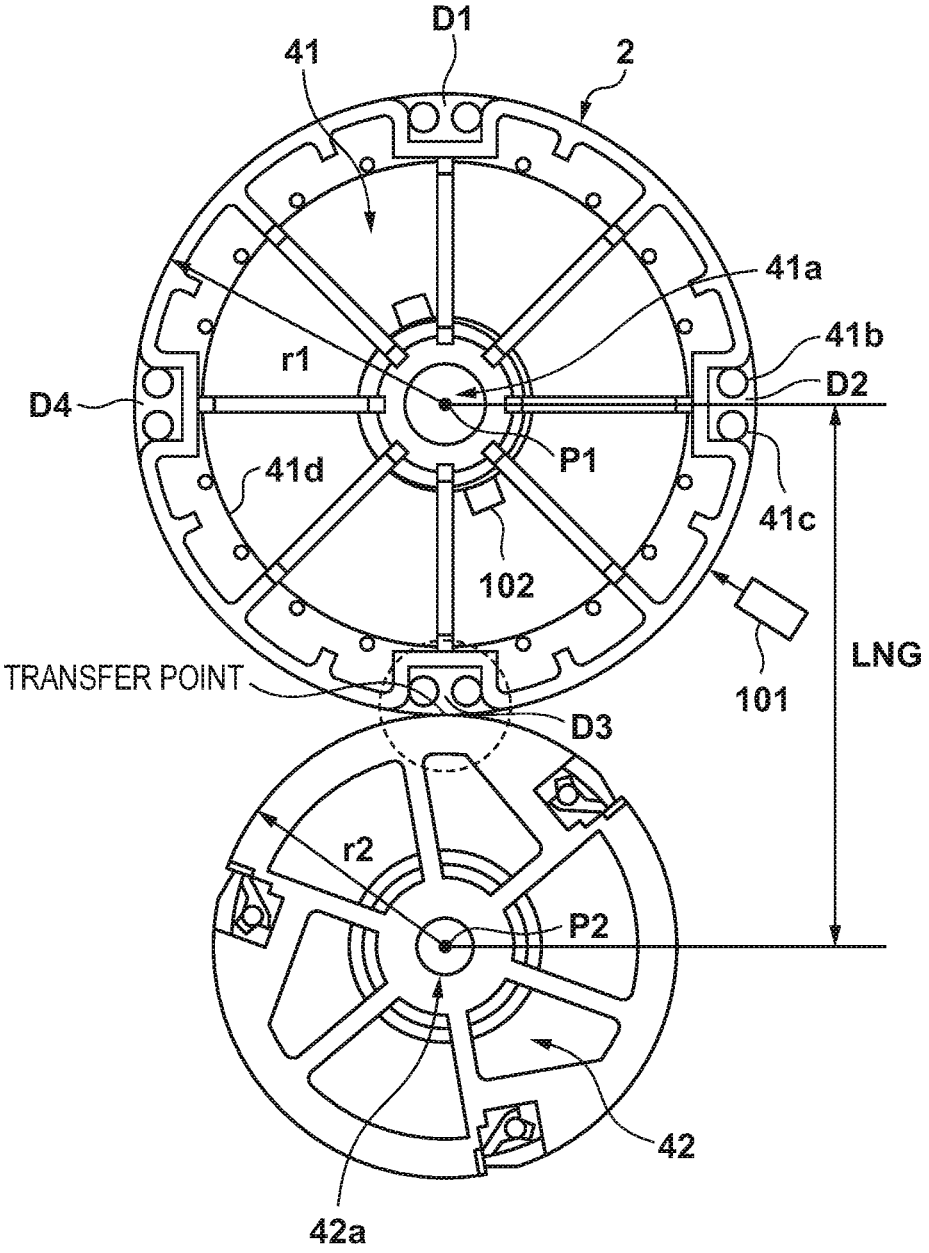
FIG. 8 is a side view schematically showing the arrangement of a surface inspection of the transfer member.

FIG. 8 is a side view schematically showing the arrangement of a surface inspection of the transfer member.

As shown in FIG. 8, the transfer member 2 is provided on the outer peripheral surface of the transfer drum 41. The transfer drum 41 includes four concave portions D1 to D4 along its outer periphery every 90° and four transfer regions obtained by mounting blankets having the same outer peripheral length between the two adjacent concave portions (D1-D2, D2-D3, D3-D4, and D4-D1). The transfer member 2 is formed by these four transfer regions. The blankets can be replaced as consumables, and each blanket can be detached. Two ends of each blanket are nipped by two nip members 41*b* and 41*c* provided in a corresponding one of the concave portions D1 to D4, thereby fixing the blanket to the transfer drum 41.

Note that in an example shown in FIG. 8, the transfer member 2 is formed by mounting four blankets on the transfer drum 41. The transfer member 2 may, however, be formed by mounting six, eight, or another number, of blankets.

Then, the transfer member 2 rotates clockwise about a rotating shaft 41*a* with a position P1 as the center. On the other hand, the pressurizing drum 42 provided facing the transfer member 2 rotates counterclockwise about a rotating shaft 42*a* with a position P2 as the center.

The transfer drum 41 on which the transfer member 2 is provided has a columnar shape with a radius r1, and the pressurizing drum 42 has a columnar shape with a radius r2. A distance between the transfer drum 41 and the pressurizing drum 42 is defined as an axis to axis distance between the center positions (axes) P1 and P2 of the respective rotating shafts. FIG. 8 shows this distance as an LNG. Each of the transfer drum 41 and the pressurizing drum 42 has a depth with a length DP in a direction perpendicular to a paper surface.

As indicated by a thick dotted line in FIG. 8, a nip portion is formed by the pressurizing drum 42 and the transfer drum 41 in which the transfer member 2 is provided, the print medium P is nipped by this nip portion, and an image formed on the transfer member 2 is transferred to the print medium P.

Furthermore, an optical sensor 101 is provided at a position slightly apart from the outer peripheral surface of the transfer member 2, and the transfer member 2 is irradiated with a laser beam from the optical sensor 101 in a normal direction, making it possible to detect the surface condition of the transfer member 2 from the reflected light. If the surface of the transfer member 2 is smooth and free of a scratch, or the like, a light reception intensity of the reflected light indicates a predetermined value or a value falling within a predetermined range. In contrast to this, if the surface has a scratch, roughness of the surface increases, light is reflected diffusely on the surface, and a light reception intensity of light received by a light-receiving unit of the optical sensor 101 decreases greatly. It is, therefore, possible to detect the surface condition of the transfer member 2 by monitoring a light reception intensity of the optical sensor 101.

On the other hand, an encoder 102 is provided in the vicinity of the rotating shaft 41*a* of the transfer member 2. The encoder 102 can detect the rotation angle of the transfer drum 41. It is, therefore, possible to identify the surface condition of the transfer member 2 as a function of the rotation angle of the transfer member 2 from detection results of the optical sensor 101 and encoder 102.

Note that the present invention is not limited by an arrangement in which the encoder 102 is provided in the vicinity of the rotating shaft 41*a* of the transfer member 2. An arrangement may be used in which, for example, the encoder is provided in the vicinity of an inner periphery 41*d* of the transfer drum 41 so as to mount an encoder film with slits at predetermined intervals along the inner periphery 41*d* of the transfer drum 41 and to read the encoder film.

Figure 9:
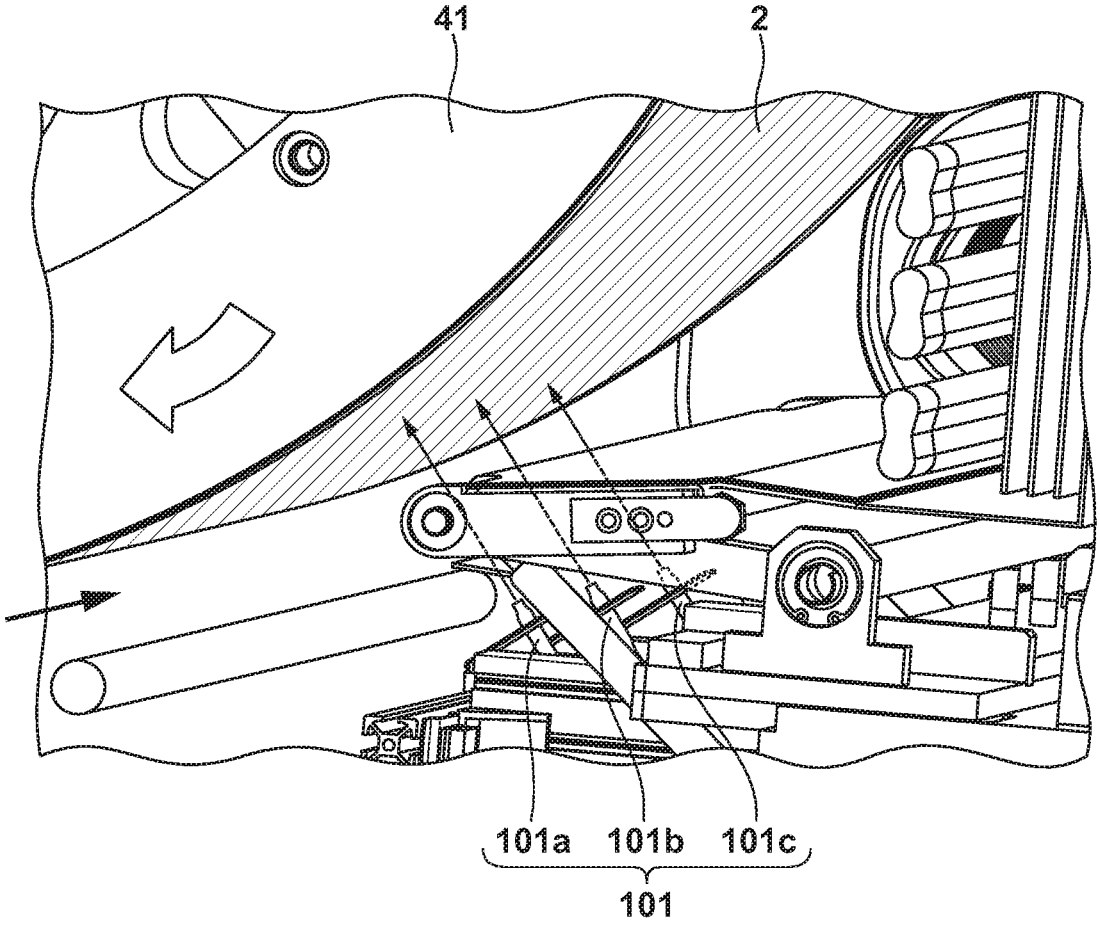
FIG. 9 is a perspective view showing a state of the transfer member near a place in which an optical sensor is provided when viewed in a depth direction.

FIG. 9 is a perspective view showing a state of the transfer member near a portion in which the optical sensor is provided when viewed in a depth direction.

The number of optical sensors 101 detecting the surface condition of the transfer member 2 need not be one. A plurality of optical sensors 101 may be provided in the depth direction of the transfer drum 41 (an axial direction of the rotating shaft 41*a*) as indicated by an arrow in FIG. 9. FIG. 9 shows an example in which three optical sensors 101*a*, 101*b*, and 101*c* are provided in the depth direction of the transfer drum 41. It becomes possible, by thus providing the plurality of optical sensors in the depth direction of the transfer member 2 at positions in which the rotation angles of the transfer member 2 are the same, to detect the surface condition of the transfer member 2 at positions that are different in depth direction and have the same rotation angle.

Figure 10A:
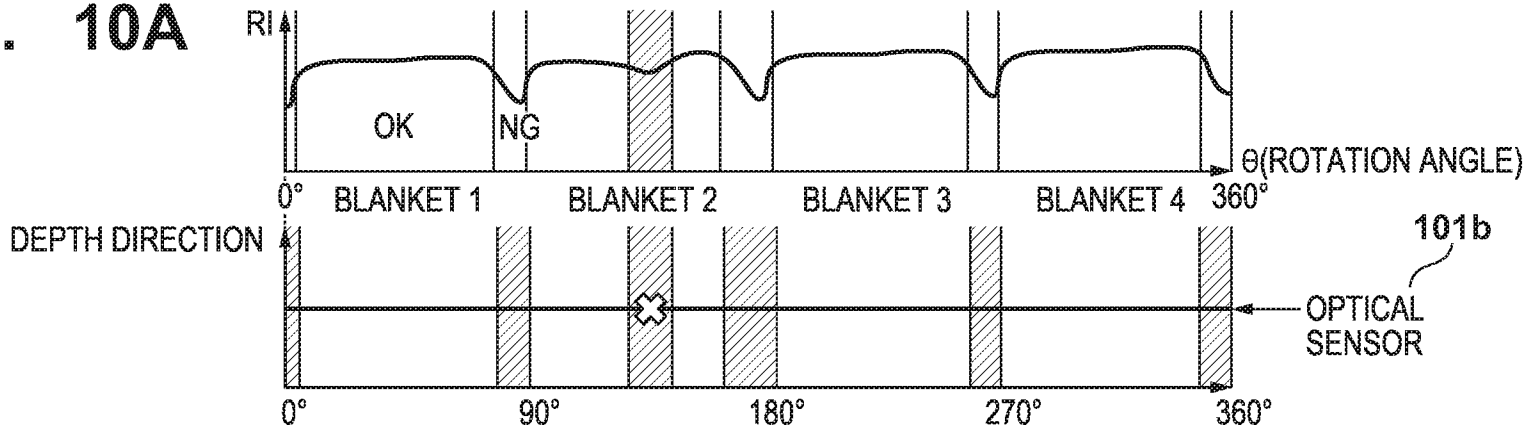
FIGS. 10A and 10B are charts showing measurement results on the surface of the transfer member by optical sensors in accordance with the rotation angle of the transfer member.
Figure 10B:
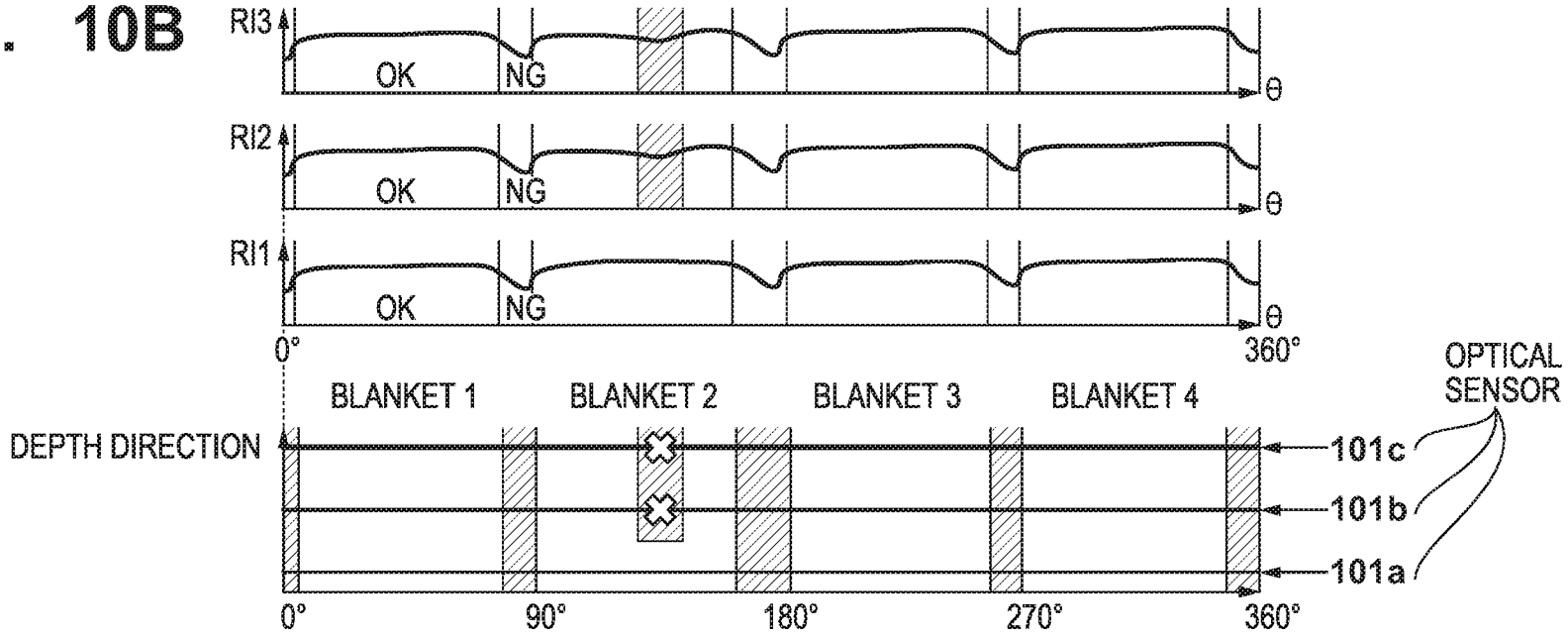

FIGS. 10A and 10B are charts showing measurement results on the surface of the transfer member by the optical sensors in accordance with the rotation angle of the transfer member.

FIG. 10A shows a state in which the surface of the transfer member 2 is measured by using one optical sensor (for example, the optical sensor 101*b*). FIG. 10B shows a state in which the surface of the transfer member 2 is measured by using three optical sensors (for example, the optical sensors 101*a* to 101*c*).

The measurement results on the surface of the transfer member 2 shown in FIGS. 10A and 10B are obtained by causing the transfer member 2 to make one rotation (0° to 360°), and the abscissa indicates a rotation angle (θ) of the transfer member. As described above, the transfer member 2 is formed by four blankets (blankets 1 to 4) having the same outer peripheral length. Therefore, in FIGS. 10A and 10B, with respect to the rotation angle of the transfer member, the rotation angle (θ) in a portion in which the optical sensors detect the tip portion of blanket 1 is 0°.

As can be seen in FIGS. 10A and 10B, a light reception intensity (RI) is low when the optical sensor measures a boundary portion of adjacent blankets, that is, the concave portion of the transfer drum 41. Furthermore, examples shown in FIGS. 10A and 10B indicate that the light reception intensity (RI) is low when the optical sensor measures a portion of blanket 2, and the surface condition of the transfer member 2 has an abnormality.

The example shown in FIG. 10A indicates a case in which the surface of the transfer member 2 is measured by using the only one optical sensor 101*b* in the depth direction of the blankets. On the other hand, the example shown in FIG. 10B indicates three light reception intensities (RI1), (RI2), and (RI3) obtained by measuring the surface of the transfer member 2 by using the three optical sensors 101*a* to 101*c*, respectively, in the depth direction of the blankets. Accordingly, in an arrangement shown in FIG. 10A, an arrangement that identifies the surface condition of the transfer member with respect to only the rotation angle of the transfer member 2 is adopted, but, in an arrangement shown in FIG. 10B, it is possible to identify the surface condition of the transfer member with respect to the rotation angle and depth direction of the transfer member 2.

FIG. 10A shows that blanket 2 has a cross, and the surface of the transfer member is in a poor condition (NG). FIG. 10B shows that blanket 2 has two crosses in two portions, and specific portions in the depth direction are in the poor condition (NG).

With the above arrangement, if an arrangement including one optical sensor is used, it is possible to detect the surface condition of the transfer member for each blanket from the rotation angle of the transfer member. If an arrangement including the plurality of optical sensors in the depth direction of the transfer member is used, it is possible to detect the surface condition of the transfer member for each blanket and for each of regions divided by the number of optical sensors in the depth direction of the transfer member from the rotation angle of the transfer member and measurement by each optical sensor.

By using these arrangements, print control to be described below is performed in this embodiment.

FIGS. 11A to 11D are views and a graph schematically showing the outline of print control performed by the printing system 1.

Figure 11A:
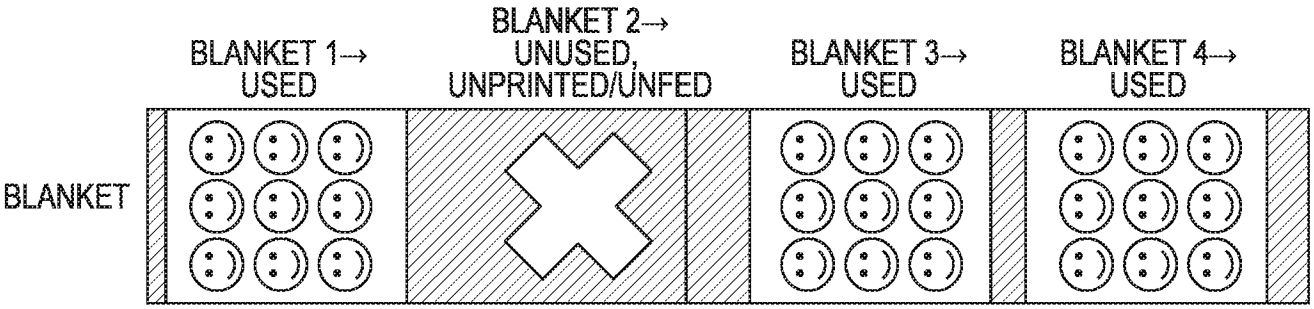
FIGS. 11A, 11B, 11C and 11D are views and a graph schematically showing the outline of print control performed by the printing system.

FIG. 11A shows an example of print control in the case in which the surface condition of the transfer member 2 is detected by using one optical sensor as shown in FIG. 10A. As in the example shown in FIG. 10A, print control when blanket 2 is in the poor condition (NG) is shown here. In this case, the printing control unit 15A prohibits the printhead 30 from forming an image by discharging ink to a transfer region corresponding to blanket 2. The transfer control unit 15B prohibits feeding of the print medium P from the feeding unit 7 at a timing when the transfer region of blanket 2 reaches a transfer point shown in FIG. 8. In contrast to this, the printhead 30 forms images by discharging ink to portions other than the transfer region of blanket 2, that is, transfer regions corresponding to blankets 1, 3, and 4, and the print medium P is fed from the feeding unit 7 at a timing when these transfer regions reach the transfer point shown in FIG. 8.

By performing the above restriction, it is possible to perform printing by using a transfer region determined to be normal, and not using a transfer region determined to be in the poor condition. Note that the blankets can be replaced as described above, and the main controller 13A may display a message to prompt blanket replacement on a display screen of the operation unit 133, or transmit the information to a higher level apparatus HK or a host apparatus HCl.

Figure 11B:
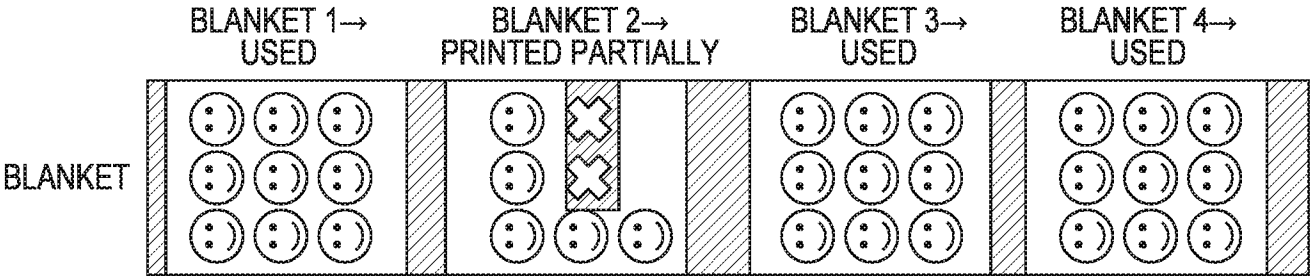

FIG. 11B shows an example of print control in the case in which the surface condition of the transfer member 2 is detected by using the three optical sensors as shown in FIG. 10B. As in the example shown in FIG. 10B, print control when two regions are in the poor condition (NG) in the depth direction of blanket 2 is shown here. As can be seen from changes in the light reception intensity RI2 and light reception intensity RI3 of FIG. 10B, blanket 2 is not determined to be poor over an entire region in a rotation direction, but is determined to be poor partially in the rotation direction as well.

In this case, the printing control unit 15A prohibits the printhead 30 from forming images by discharging ink to transfer regions corresponding to the two regions in the depth direction of blanket 2 that are region portions determined to be poor with respect to the rotation direction. As in a case in which all blankets 1 to 4 are determined to be in a normal condition, the transfer control unit 15B feeds the print medium P from the feeding unit 7 at the timing when the transfer region of each blanket reaches the transfer point shown in FIG. 8.

By performing the above control, it is possible to perform printing by excluding a local region determined to be in the poor condition of a blanket determined to be in the poor condition and using another transfer region determined to be normal of a blanket determined to be in the poor condition. This makes it possible to continue printing by making effective use of a blanket that is in the poor condition locally when image data causes image formation by using not the entire region of one blanket, but a partial region of one blanket.

Note that in this case as well, the main controller 13A displays a message to prompt blanket replacement or blanket maintenance on the display screen of the operation unit 133, or transmits the information to the higher level apparatus HK or the host apparatus HCl.

Figure 11C:
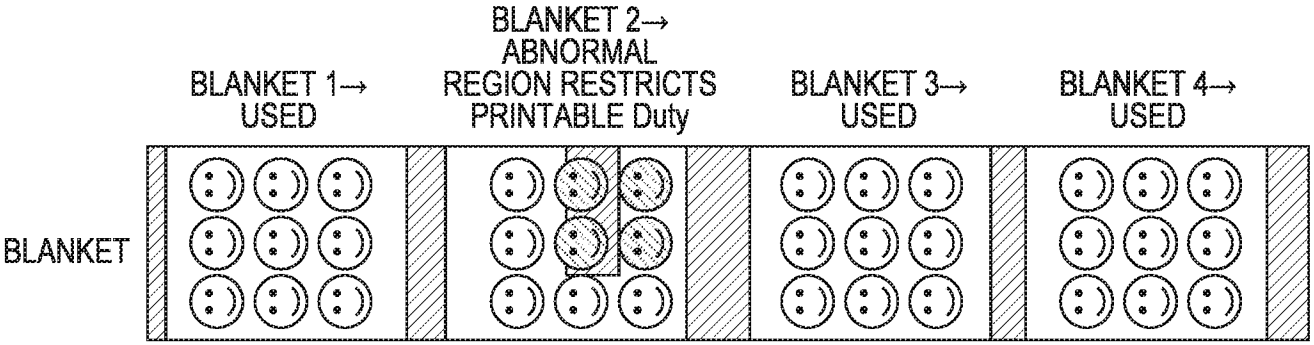

FIG. 11C shows another example of print control in the case in which the surface condition of the transfer member 2 is detected by using the three optical sensors as shown in FIG. 10B. In addition to the same condition as in the example shown in FIG. 10B, a print duty (DUTY) based on image data is considered here.

Figure 11D:
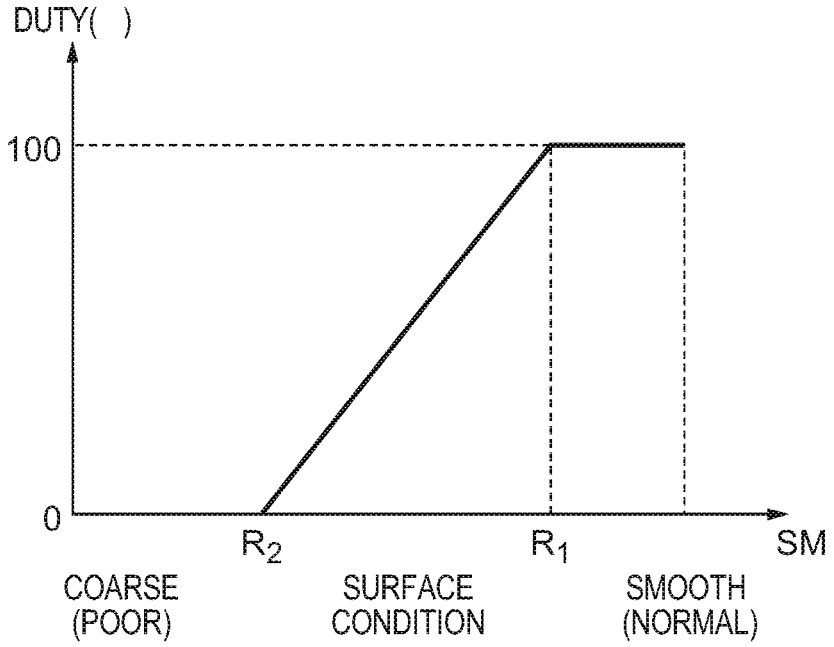

FIG. 11D is a graph showing a relationship between the tolerable print duty (DUTY) and the surface condition of the transfer member. FIG. 11D shows a relationship between the tolerable print duty (%) and smoothness (SM) obtained by quantifying the surface condition of the transfer member. According to FIG. 11D, if the smoothness is greater than a first threshold ($R_1$), and the surface of the transfer member is smooth, an image can be formed normally on the transfer member regardless of the print duty. In this case, the image is formed as usual. On the other hand, if the smoothness is less than a second threshold ($R_2$), the transfer member is not suitable for image formation regardless of the print duty. In this case, the image is not formed as described with reference to FIG. 11B.

In contrast to this, if the smoothness is in between the first threshold ($R_1$) and the second threshold ($R_2$), that is, $R_2 \leq SM \leq R_1$, the tolerable print duty (DUTY) changes. Therefore, the duty of the image data that is used to print the image in the local region that is determined to be in the poor condition described in FIG. 11B is checked, and the duty (DUTY) is compared with the smoothness (SM) of the local region determined to be in the poor condition. Note that if SM>DUTY, as shown in FIG. 11C, an image is also formed in the region determined to be in the poor condition. In contrast to this, if SM≤DUTY, an image is not formed in the region determined to be in the poor condition.

By performing the above restriction, it is possible to form an image even in the region determined to be in the poor condition of the blanket determined to be in the poor condition if the duty of image data used to perform image formation in the region is low. This makes it possible to continue printing by making effective use of a blanket, a partial region of which is in the poor condition, in consideration of the print duty based on the image data.

Alternatively, a restriction by the print duty need not be based on the image data, and printing may be performed in which a print density is made lower by forcibly changing a density value of each pixel represented by the image data to be the tolerable print duty or less. This control leads to the extension of a blanket replacement period and contributes to a reduction in operation cost.

Note that in this case as well, the main controller 13A displays the message to prompt blanket replacement or maintenance on the display screen of the operation unit 133, or transmits the information to the higher level apparatus HK or the host apparatus HCl.

Therefore, according to the above-described embodiment, it is possible to measure the surface of the transfer member by using one or more optical sensors and further to locate a specific region on the surface of the transfer member that is in the poor condition from the rotation angle of the transfer member or an installation position of each optical sensor. This makes it possible to continue printing without using the located place partially. As a result, effective use of the transfer member can be made. In consideration of the print duty based on the image data, it also becomes possible to form an image in a local region determined to be in the poor condition.

In the above embodiment, the print unit 3 includes the plurality of printheads 30. The print unit 3 may, however, include one printhead 30. The printhead 30 may not be a full-line head, but may be of a serial type that forms an ink image while moving the printhead 30 in a Y direction and discharging ink from the printhead 30.

A conveyance mechanism of the print medium P may adopt another method, such as a method of clipping and conveying the print medium P by the pair of rollers. In the method of conveying the print medium P by the pair of rollers, or the like, a roll sheet may be used as the print medium P, and a printed product P' may be formed by cutting the roll sheet after transfer.

In the above embodiment, the transfer member 2 is provided on the outer peripheral surface of the transfer drum 41. Another method, such as a method of forming a transfer member 2 into an endless swath and running it cyclically, may, however, be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A printing apparatus comprising:

a transfer member that rotates;

a printhead configured to form an image on the transfer member;

a transfer unit configured to transfer, to a print medium, the image formed on the transfer member;

a detection unit configured to detect a surface condition of the transfer member;

a specifying unit configured to specify a region of the transfer member in which the surface condition is poor, based on a detection result output by the detection unit; and a prohibiting unit configured to prohibit image formation by the printhead for the region of the transfer member, specified by the specifying unit, for which the surface condition is poor.

2. The printing apparatus according to claim 1, further comprising a measurement unit configured to measure a rotation angle of the transfer member.

3. The printing apparatus according to claim 2, wherein the specifying unit specifies, based on the rotation angle measured by the measurement unit, the region of the transfer member.

4. The printing apparatus according to claim 2, wherein the detection unit includes an optical sensor provided at a position spaced apart from an outer peripheral surface of the transfer member, and the measurement unit includes an encoder provided in one of a vicinity of a rotating shaft of the transfer member and a vicinity of an inner periphery of the transfer member.

5. The printing apparatus according to claim 4, wherein the surface condition of the transfer member is specified based on a light reception intensity obtained by causing the optical sensor to receive reflected light of light that irradiates a surface of the transfer member.

6. The printing apparatus according to claim 4, wherein the detection unit further includes a plurality of the optical sensors provided at different positions along an axial direction of the rotating shaft, and, based on respective measurement results of the plurality of the optical sensors, the surface condition of the transfer member is specified to be one of normal and poor for each region, of a plurality of regions, defined by dividing an area of a surface of the transfer member in the axial direction of the rotating shaft.

7. The printing apparatus according to claim 6, wherein the prohibiting unit prohibits image formation for a region, of the plurality of regions, for which the surface condition, as specified by the specifying unit, is poor, the region being divided in the axial direction of the rotating shaft.

8. The printing apparatus according to claim 6, further comprising a control unit configured to change, based on a tolerable print duty of the surface condition of the transfer member detected by the detection unit, a density value of image data used for image formation, and to cause the printhead to perform image formation for the region for which the specifying unit specifies that the surface condition of the transfer member is poor, the region being divided in the axial direction of the rotating shaft.

9. The printing apparatus according to claim 6, further comprising a control unit configured to perform, if a print duty based on image data used for image formation is less than a tolerable print duty of the surface condition of the transfer member detected by the detection unit, image formation for the region for which the specifying unit specifies that the surface condition of the transfer member is poor using the image data, the region being divided in the axial direction of the rotating shaft.

10. The printing apparatus according to claim 1, wherein the transfer member is formed by a plurality of replaceable blankets mounted along an outer peripheral surface of a rotating drum, and the surface condition is specified to be one of normal and poor by using the blankets as a unit.

11. The printing apparatus according to claim 10, wherein the prohibiting unit prohibits image formation for a blanket, of the plurality of replaceable blankets, for which the surface condition, as specified by the specifying unit, is poor.

12. The printing apparatus according to claim 11, further comprising a display unit configured to display a message that prompts one of replacement and maintenance of one of a blanket, of the plurality of replaceable blankets, for which the image formation is prohibited, and a blanket, of the plurality of replaceable blankets, including a region in which the image formation is prohibited.

13. The printing apparatus according to claim 1, wherein the printhead is a printhead configured to perform printing by discharging ink.

14. The printing apparatus according to claim 1, wherein the detection unit includes an optical sensor, and the surface condition is specified based on a light reception intensity of light received by the optical sensor included in the detection unit.

15. A print control method of controlling a printing apparatus that includes a transfer member that rotates, a printhead configured to form an image on the transfer member, and a transfer unit configured to transfer, to a print medium, the image formed on the transfer member, the method comprising the steps of:

detecting a surface condition of the transfer member;

specifying a region of the transfer member in which the surface condition is poor, based on a result of the detecting step; and prohibiting image formation by the printhead for the region of the transfer member, specified by the specifying unit, for which the surface condition is poor.

* * * * *